US010266338B2

(12) United States Patent
Park

(10) Patent No.: US 10,266,338 B2
(45) Date of Patent: Apr. 23, 2019

(54) MANUFACTURING METHOD FOR OVERLAP-STRUCTURED CONTAINER BAG

(71) Applicant: Chan kyung Park, Gangneung-si (KR)

(72) Inventor: Chan kyung Park, Gangneung-si (KR)

( * ) Notice: Subject to any disclaimer, the term of this patent is extended or adjusted under 35 U.S.C. 154(b) by 0 days.

(21) Appl. No.: 15/918,331

(22) Filed: Mar. 12, 2018

(65) Prior Publication Data

US 2018/0265280 A1 Sep. 20, 2018

(30) Foreign Application Priority Data

Mar. 20, 2017 (KR) ..... 10-2017-0034405
May 17, 2017 (KR) ..... 10-2017-0060809

(51) Int. Cl.
*B65D 88/16* (2006.01)

(52) U.S. Cl.
CPC ..... *B65D 88/1618* (2013.01); *B65D 88/1606* (2013.01); *B65D 88/1631* (2013.01); *B65D 88/1681* (2013.01)

(58) Field of Classification Search
CPC ..... B65D 88/16; B65D 88/1606; B65D 88/1612; B65D 88/1618; B65D 88/1625; B65D 88/1631; B65D 88/1637; B65D 88/1643; B65D 88/165; B65D 88/1656; B65D 88/1662; B65D 88/1668; B65D 88/1675; B65D 88/1681; B65D 88/1687; B65D 88/1693; B65D 88/18; B65D 88/20; B65D 88/22; B65D 88/24
USPC ..... 383/111, 119, 105
See application file for complete search history.

(56) References Cited

U.S. PATENT DOCUMENTS 4,807,299 A * 2/1989 Nattrass ..... B65D 88/1618 383/109
5,938,338 A * 8/1999 McDonough ..... B65D 88/1618 220/495.06
2003/0235349 A1* 12/2003 Ricahrdson, Jr. .. B65D 88/1618 383/16
2005/0196080 A1* 9/2005 Stone ..... B65D 19/06 383/119

FOREIGN PATENT DOCUMENTS

JP 02085186 A * 3/1990 ..... B65D 88/1681
JP 05-092187 12/1993
(Continued)

OTHER PUBLICATIONS

KIPO, Notice of Grounds for Refusal of KR 10-2017-0060809 dated Jul. 7, 2017.

*Primary Examiner* — Jes F Pascua
*Assistant Examiner* — Nina K Attel
(74) *Attorney, Agent, or Firm* — Lex IP Meister, PLLC

(57) ABSTRACT

Disclosed herein is an overlap-structured container bag having an inner bag inserted into an outer bag. In the overlap-structured container bag comprises: (A1) weaving fabric used for a container bag of a hollow structure while a plurality of vertical reinforcing portions are formed; (A2) cutting container bag fabric in unit length; (A3) forming at least one of the lateral reinforcing portion on the inner bag when either one of the upper or lower portion of the cut container bag is selected as the inner bag; (A4) placing the inner bag into the outer bag by turning the open end of the outer bag inside out when the other one where the lateral reinforcing portion is not formed is selected as the outer bag.

24 Claims, 22 Drawing Sheets

(56) References Cited

FOREIGN PATENT DOCUMENTS

| | | | | |
|---|---|---|---|---|
| JP | 2003312775 | A | * | 11/2003 |
| JP | 2014-031196 | | | 2/2014 |
| JP | 2015-182787 | | | 10/2015 |
| KR | 10-2004-0027809 | | | 4/2004 |

* cited by examiner

MANUFACTURING METHOD FOR OVERLAP-STRUCTURED CONTAINER BAG

BACKGROUND

1. Technical Field

The present invention relates to an overlap-structured container bag having an inner bag and an outer bag made by turning container bag fabric inside out through an overlapping process.

More specifically, the present invention relates to a container bag having an overlap structure, which is capable of minimizing an expansion phenomenon which is generated due to contents introduced into the container bag.

2. Description of the Related Art

The present invention relates to a flexible intermediate bulk container (FIBC; hereinafter referred to as a "container bag") which is used to pack and transport various contents, such as polypropylene (PP), polyethylene (PE), raw resin materials, raw grain materials, etc. In particular, the container bag has been contrived to pack grain or crops, to pack plastic-based synthetic resin, and to pack heavy products, such as mineral products and the like, in bulk. The container bag is also called an industrial bag, etc.

Over a long period, the container bag has been used to pack and transport heavy particle or powder materials. The container bag is made of fabric woven with threads or tapes made of polypropylene or corresponding material. The container bag has a shape in which four belts (straps) are provided on four corners or in which two belts are connected at a point.

Theoretically, such a container bag may be used to handle a load ranging from 500 to 2000 kg, and is lifted by a fork lift or crane and transported by a large-sized truck or container for the purpose of long-distance transportation.

However, the loading capacity of a general container bag is actually about 1000 kg for the sake of security. The conventional container bag is problematic in that when the conventional container bag is fully loaded and then lifted with belts on four corners or moved after being lifted, the lower portion of the body of the container bag is expanded and the upper portion of the body is contracted, and thus the container bag does not maintain an upright rectangular parallelepiped shape. This is a phenomenon which is generated because contents introduced into the container bag are moved downward due to gravity.

According to the conventional technology, partitions are formed at the corners of the internal space of the container bag in order to maintain the upright shape of the container bag. However, when the specific structure is formed in the internal space, a disadvantage arises in that a separate liner is not additionally disposed inside the internal space. In particular, the conventional technology is problematic in that it is difficult to apply the conventional technology to hygroscopic or powder material requiring a separate liner.

Moreover, there are many cases where impurities remain on the partitions formed inside the container bag during a complex manufacturing process. In particular, dust is generated or separated due to the friction between the partitions and introduced material. Accordingly, it is proved that the partitions are a cause for the generation of impurities in contents.

PRIOR ART DOCUMENT

Patent Document (Patent document 1) 1. Korean Patent No. 10-1032147 (issued on Apr. 22, 2011)

SUMMARY

Manufacturing method for overlap-structured container bag and the container bag according to the present invention has the following objects:

A first object of the present invention is to provide a dual structure in which an inner bag and an outer bag are disposed by overlapping the same bag body.

A second object of the present invention is to very simplify manufacturing process, but to prevent expansion phenomenon of a container bag.

A third object of the present invention is to minimize the expansion phenomenon of a container bag when materials are introduced into the container bag.

A fourth object of the present invention is to keep a container bag upright while maintaining corners when materials to be transported are introduced into the container bag.

The objects of the present invention are not limited to those mentioned above, and other objects which are not mentioned herein will be clearly understood by those skilled in the art from the following description.

A manufacturing method for overlap-structured container bag according to the present invention comprises: (A1) weaving fabric used for a container bag of a hollow structure while a plurality of vertical reinforcing portions are formed; (A2) cutting container bag fabric in unit length; (A3) forming at least one of the lateral reinforcing portion on the inner bag when either one of the upper or lower portion of the cut container bag is selected as the inner bag; (A4) placing the inner bag into the outer bag by turning the open end of the outer bag inside out when the other one where the lateral reinforcing portion is not formed is selected as the outer bag; and wherein the lateral reinforcing portions are formed by folding a part of the inner bag outward in a lateral direction, and are disposed in a space between the inner bag and the outer bag.

The vertical reinforcing portions of the step A1 may be warp-reinforced woven portions which are woven such that warp more than weft is added thereto.

The lateral reinforcing portions may be formed by folding a part of the inner bag, and a internal path may be provided inside the lateral reinforcing portion.

A reinforcing belt may be inserted into the internal path.

When the lateral reinforcing portions comprise a plurality of lateral reinforcing portions, the strengths of respective reinforcing belts may stronger at the lower position.

When the lateral reinforcing portions comprise a plurality of lateral reinforcing portions, the heights H of respective lateral reinforcing portions may higher at the lower position.

When the lateral reinforcing portions are three or more in number, the intervals I between lateral reinforcing portions may narrower at the lower position.

After the step A4, vertical reinforcing portions may be formed on each side surface of the outer bag; lifting loops may be coupled to tops of the vertical reinforcing portions; and a connection portion may be passed through the lifting loops.

The vertical reinforcing portions may be provided on center portions of each side surface of the outer bag; and two lifting loops may be disposed in parallel on top of each vertical reinforcing portion.

Tops of the lifting loops may be disposed at the same height of tops of the outer bag or may be disposed above the tops of the outer bag.

The connection portion may be passed through the lifting loops which are opposite to each other with a corner of each side surface of the container bag disposed therebetween.

The connection portion may be passed through at least two of the lifting loops.

The connection portion may be provided in a belt or a string shape.

After the step A4, an upper plate and a lower plate may be coupled to an open top and bottom of the container bag, respectively.

A lamination layer may be formed on surface of container bag fabric when the step A1 is ended and the step A2 is before the start or when the step A2 is ended and the step A3 is before the start.

A liner may be additionally disposed in an internal space of the inner bag.

An overlap-structured container bag may be made by the manufacturing method according to the present invention.

In accordance with an embodiment, a manufacturing method for overlap-structured container bag according to the present invention comprises: (B1) preparing cut fabric of hollow structured container bag; (B2) placing the inner bag into the outer bag by turning the outer bag inside out when either one of the upper or lower portion of the cut container bag is selected as the inner bag, the other one is selected as the outer bag.

In accordance with an embodiment, a manufacturing method for overlap-structured container bag according to the present invention comprises: (C1) weaving fabric used for a container bag of a hollow structure while a plurality of vertical reinforcing portions are formed; (C2) cutting container bag fabric in unit length; (C3) forming the vertical reinforcing portion padded the reinforcing belt on outer bag when either one of the upper or lower portion of the cut container bag is selected as the outer bag, the other one is selected as the inner bag; (C4) placing the inner bag into the outer bag by turning the open end of the outer bag inside out.

In accordance with an embodiment, a manufacturing method for overlap-structured container bag according to the present invention comprises: (D1) weaving fabric used for a container bag of a hollow structure; (D2) cutting container bag fabric in unit length; (D3) forming the lateral reinforcing portion by folding a part of the inner bag on the inner bag when either one of the upper or lower portion of the cut container bag is selected as the inner bag; (D4) placing the inner bag into the outer bag by turning the open end of the outer bag inside out when the other one where the lateral reinforcing portion is not formed is selected as the outer bag.

The lateral reinforcing portions are formed by folding a part of the inner bag outward in a lateral direction, and are disposed in a space between the inner bag and the outer bag.

In accordance with an embodiment, a manufacturing method for overlap-structured container bag according to the present invention comprises: (E1) weaving fabric used for a container bag 10 of a hollow structure; (E2) cutting container bag fabric in unit length; (E3) forming the lateral reinforcing portion 110 by folding a part of the inner bag on the inner bag 100 when either one of the upper or lower portion of the cut container bag is selected as the inner bag 100, and forming the vertical reinforcing portion 210 padded the reinforcing belt on the outer bag 200 when the other one is selected as the outer bag 200; (E4) placing the inner bag 100 into the outer bag 200 by turning the open end of the outer bag inside out.

The lateral reinforcing portions may be formed by folding a part of the inner bag outward in a lateral direction, and may be disposed in a space between the inner bag and the outer bag.

The present invention is directed to a container bag having an inner bag and an outer bag made by turning container bag fabric inside out.

Either one of the upper or lower portion of the cut container bag may be selected as an inner bag, the other one is selected as an outer bag; the inner bag may be placed into the outer bag by turning container bag fabric inside out; the lateral reinforcing portions may be formed by folding a part of the inner bag, and may be provided on the inner bag; the vertical reinforcing portions may be provided on the respective side surfaces of the outer bag; and the lateral reinforcing portions may be formed by folding a part of the inner bag outward in a lateral direction, and may be disposed in a space between the inner bag and the outer bag.

The internal path may be provided inside the lateral reinforcing portion; and the reinforcing belt may be inserted into the internal path.

The vertical reinforcing portions may be warp-reinforced woven portions which are woven such that warp more than weft is added thereto.

When the vertical reinforcing portion is the warp-reinforced woven portion, the warp-reinforced woven portion may be formed on the inner bag The outer bag includes the lifting loops which may be coupled to tops of the vertical reinforcing portions, and and a connection portion which is passed through the lifting loops; the vertical reinforcing portions may be provided on center portions of each side surface of the outer bag; each two of the lifting loops may be disposed on the tops of each vertical reinforcing portion in parallel; the connection portion may be passed through lifting loops which are opposite to each other with the corner of each side of container bag in between.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Embodiments of the present invention will be described below with reference to the accompanying drawings so that those having ordinary knowledge in the art to which the present invention pertains can easily practice the present invention. As can be understood by those having ordinary knowledge in the art to which the present invention pertains, the following embodiments may be modified in various forms without departing from the technical spirit and scope of the present invention. Throughout the accompanying drawings, the same portions are designated by the same or similar reference symbols as much as possible.

The terms used herein are used merely to describe specific embodiments, and are not intended to limit the present invention. Each singular expression used herein may include a plural expression unless clearly defined otherwise.

The term "include" or "comprise" used herein specifies a specific feature, region, integer, step, operation, element, or component, but does not exclude the presence or addition of a different specific feature, region, integer, step, operation, element, component, or group.

All terms including technical terms and scientific terms used herein have the same meanings as commonly understood by those having ordinary knowledge in the art to which the present invention pertains. Terms defined in commonly used dictionaries should be interpreted as having meanings consistent with relevant art documents and the present invention, and should not be interpreted in an ideal or overly formal sense unless expressly so defined herein.

Meanwhile, a container bag according to the present invention includes common components which constitute a typical container bag. However, descriptions of commonly used typical components will be minimized, and the following description will be given with a focus on the principal features of the present invention.

In the following description, the technical features of the present invention will be described in conjunction with the accompanying drawings. The container bag according to the present invention is provided in a polyhedral shape which can be erected upright. However, for ease of description, the present invention will be described based on a rectangular parallelepiped shape.

The present invention is directed to an overlap-structured container bag in which inner bag and outer bag are made by turning the same container bag inside out. In this specification, 'overlap' means that two layers are made by turning single layer container bag inside out.

In the following, main embodiments in which an overlap structure is made are presented.

Figure 1:
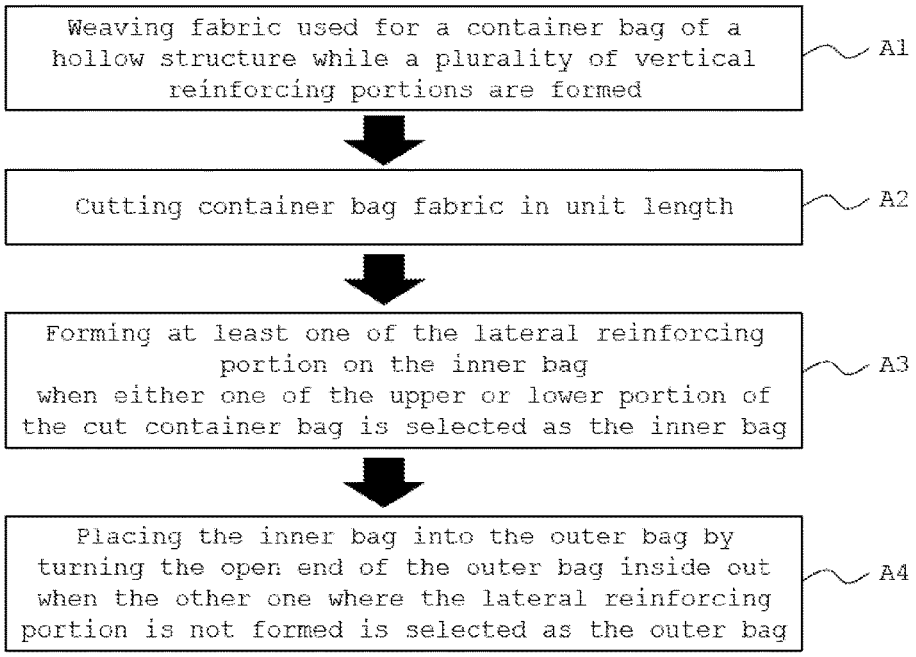
FIGS. 1 to 5 show various embodiments for manufacturing overlap-structured container bags according to the present invention.

As shown in FIG. 1, the first embodiment of the present manufacturing method comprises: (A1) weaving fabric used for a container bag 10 of a hollow structure while a plurality of vertical reinforcing portions 210 are formed; (A2) cutting container bag fabric in unit length; (A3) forming at least one of the lateral reinforcing portion 110 on the inner bag when either one of the upper or lower portion of the cut container bag is selected as the inner bag 100; (A4) placing the inner bag 100 into the outer bag 200 by turning the open end of the outer bag inside out when the other one where the lateral reinforcing portion 110 is not formed is selected as the outer bag 200.

The first embodiment means an embodiment in which the vertical reinforcing portion 210 is formed in a process in which the container bag fabric is woven. In the first embodiment, the vertical reinforcing portion 210 is formed not only on the outer bag 200 but also on the inner bag 100. Because it is the same fabric when weaving.

Figure 2:
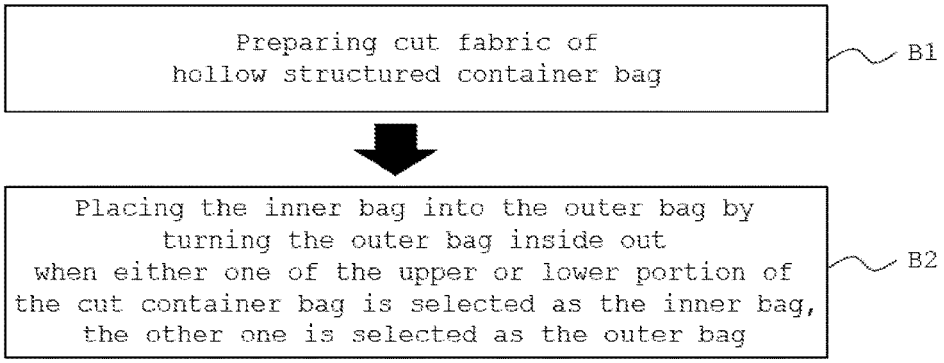

As shown in FIG. 2, the seconf embodiment of the present manufacturing method comprises: (B1) preparing cut fabric of hollow structured container bag 10; (B2) placing the inner bag 100 into the outer bag 200 by turning the outer bag inside out when either one of the upper or lower portion of the cut container bag is selected as the inner bag 100, the other one is selected as the outer bag 200.

The second embodiment describes the basic concept of overlapping to provide a dual structure of the inner bag 100 and the outer bag 200.

Figure 3:
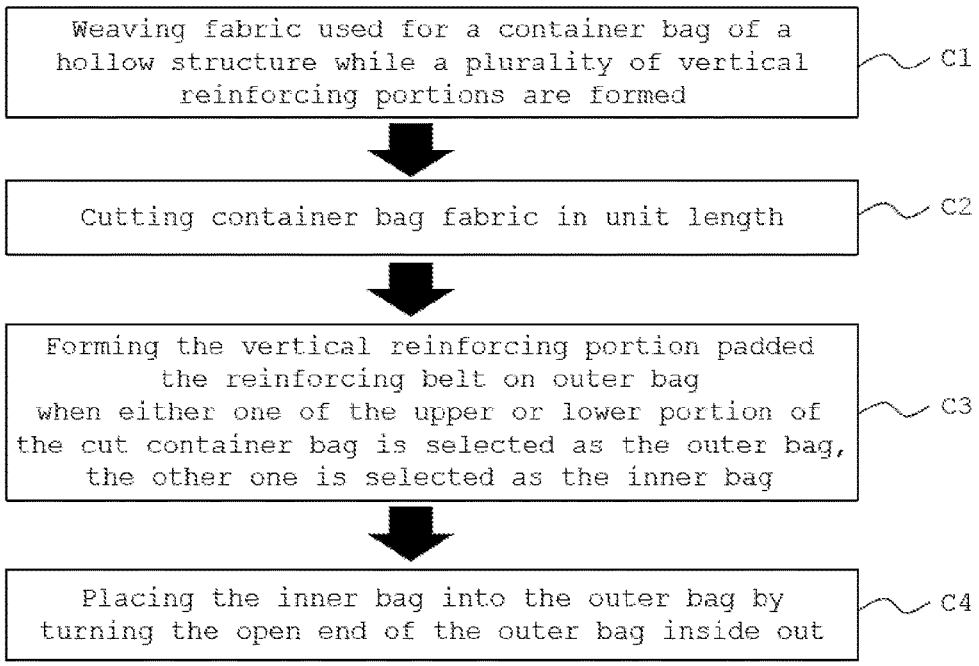

As shown in FIG. 3, the third embodiment of the present manufacturing method comprises: (C1) weaving fabric used for a container bag 10 of a hollow structure while a plurality of vertical reinforcing portions 210 are formed; (C2) cutting container bag fabric in unit length; (C3) forming the vertical reinforcing portion 210 padded the reinforcing belt on outer bag 200 when either one of the upper or lower portion of the cut container bag is selected as the outer bag 200, the other one is selected as the inner bag 100; (C4) placing the inner bag 100 into the outer bag 200 by turning the open end of the outer bag inside out.

The third embodiment is a case where a vertical reinforcing portion is formed after the container bag fabric is woven. It is desirable to put a pad in the reinforcing belt at this time. In this case, it may be possible to pad the reinforcing belt.

Figure 4:
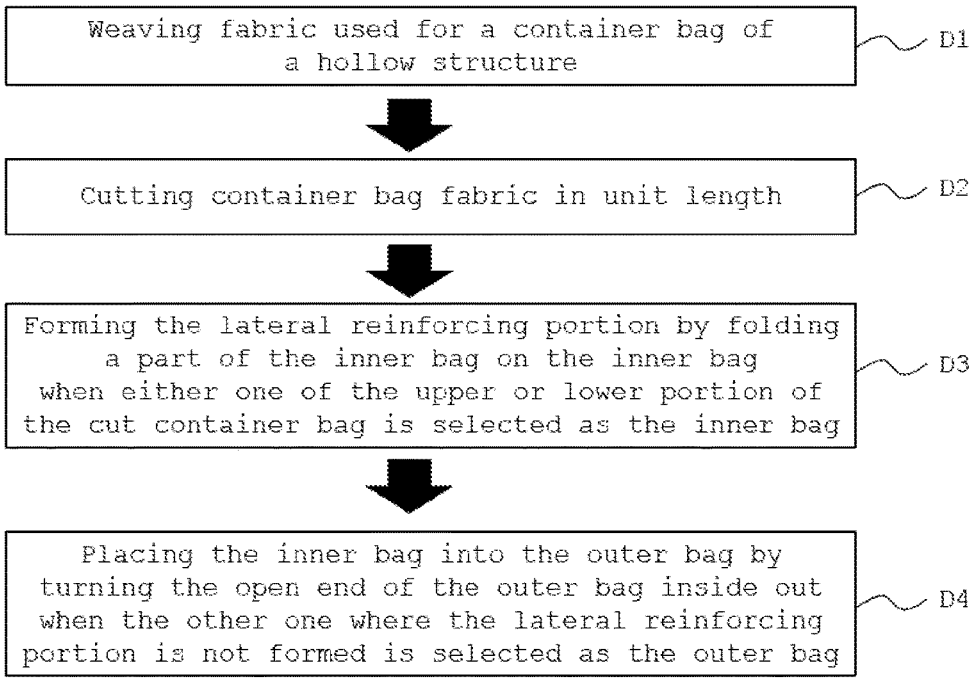

As shown in FIG. 4, the fourth embodiment of the present manufacturing method comprises: (D1) weaving fabric used for a container bag 10 of a hollow structure; (D2) cutting container bag fabric in unit length; (D3) forming the lateral reinforcing portion 110 by folding a part of the inner bag on the inner bag 100 when either one of the upper or lower portion of the cut container bag is selected as the inner bag 100; (D4) placing the inner bag 100 into the outer bag 200 by turning the open end of the outer bag inside out when the other one where the lateral reinforcing portion 110 is not formed is selected as the outer bag 200.

In the fourth embodiment, the lateral reinforcing portion 110 is formed after the container back fabric is woven, but the vertical reinforcing portion 210 is not formed.

Figure 5:
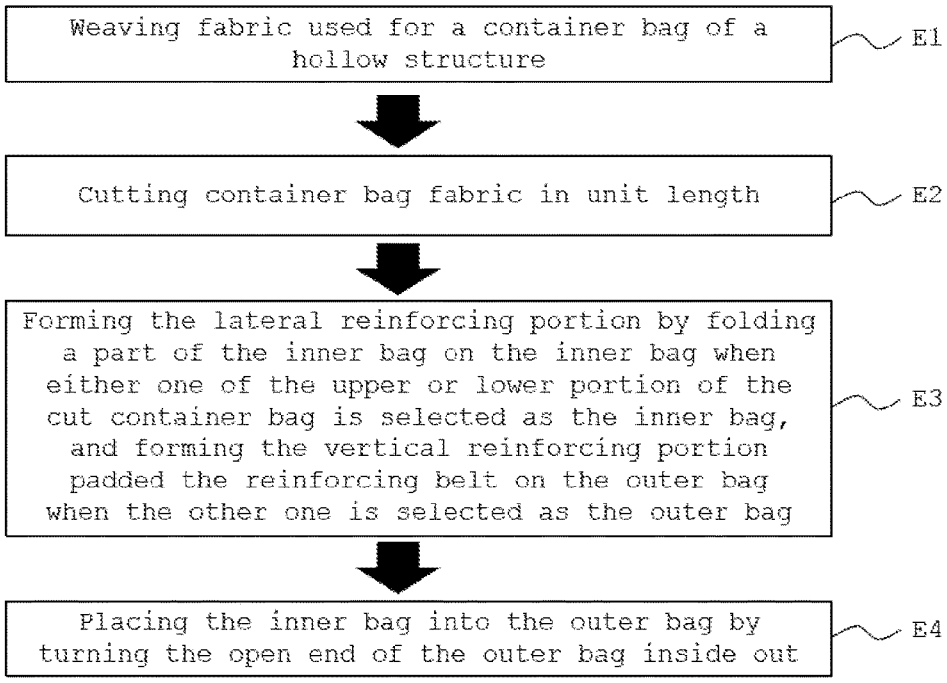
Figure 6:
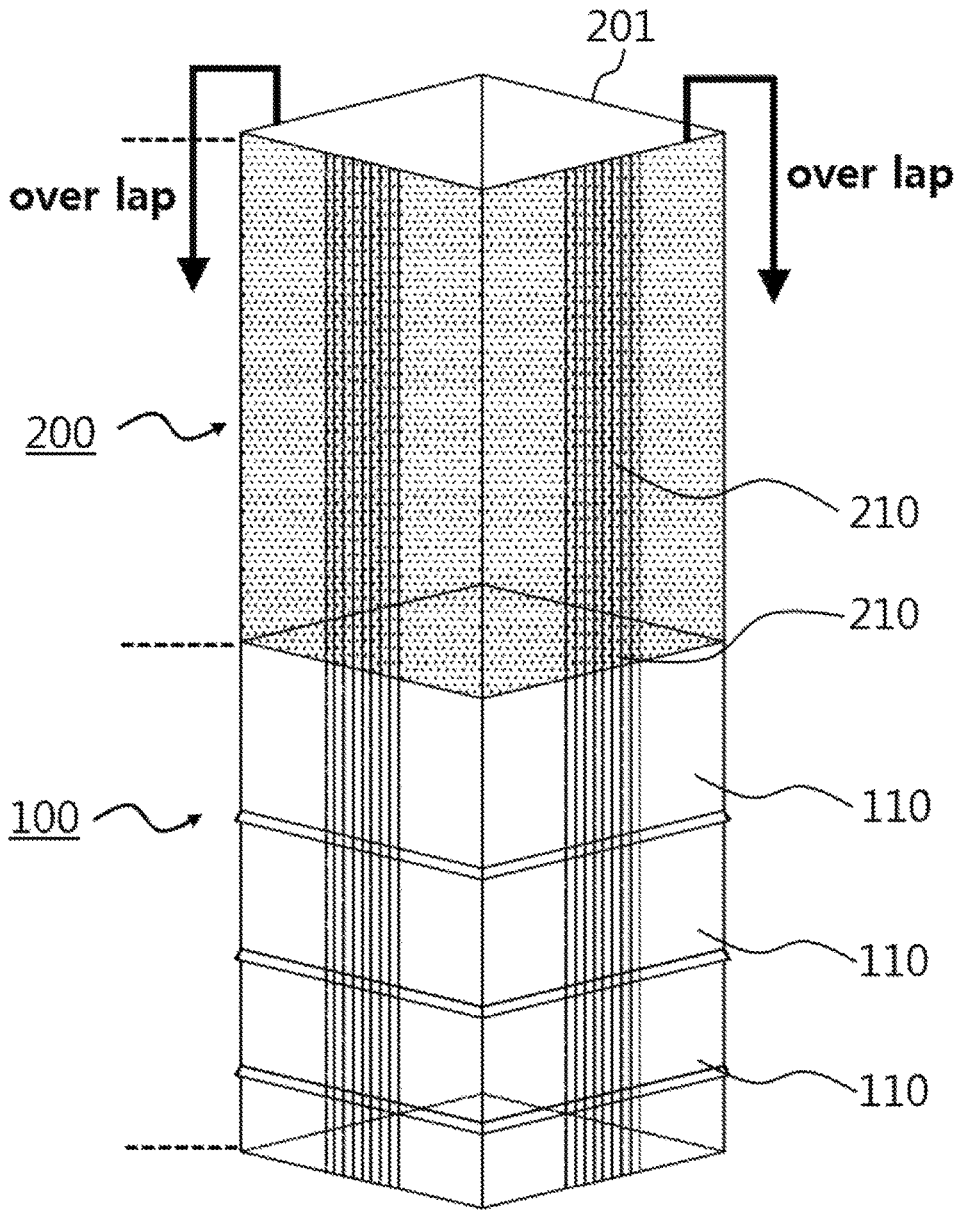
FIGS. 6 and 7 show the process of forming the overlap structure by turning the same container bag inside out.
Figure 7:
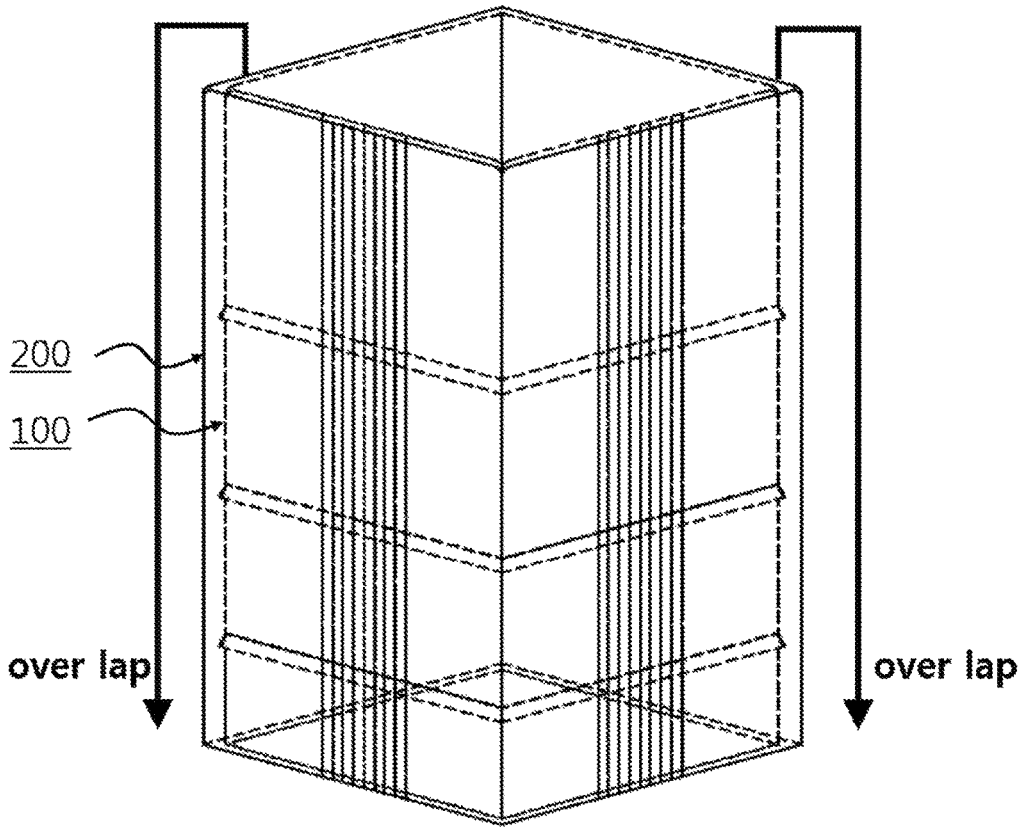
Figure 8:
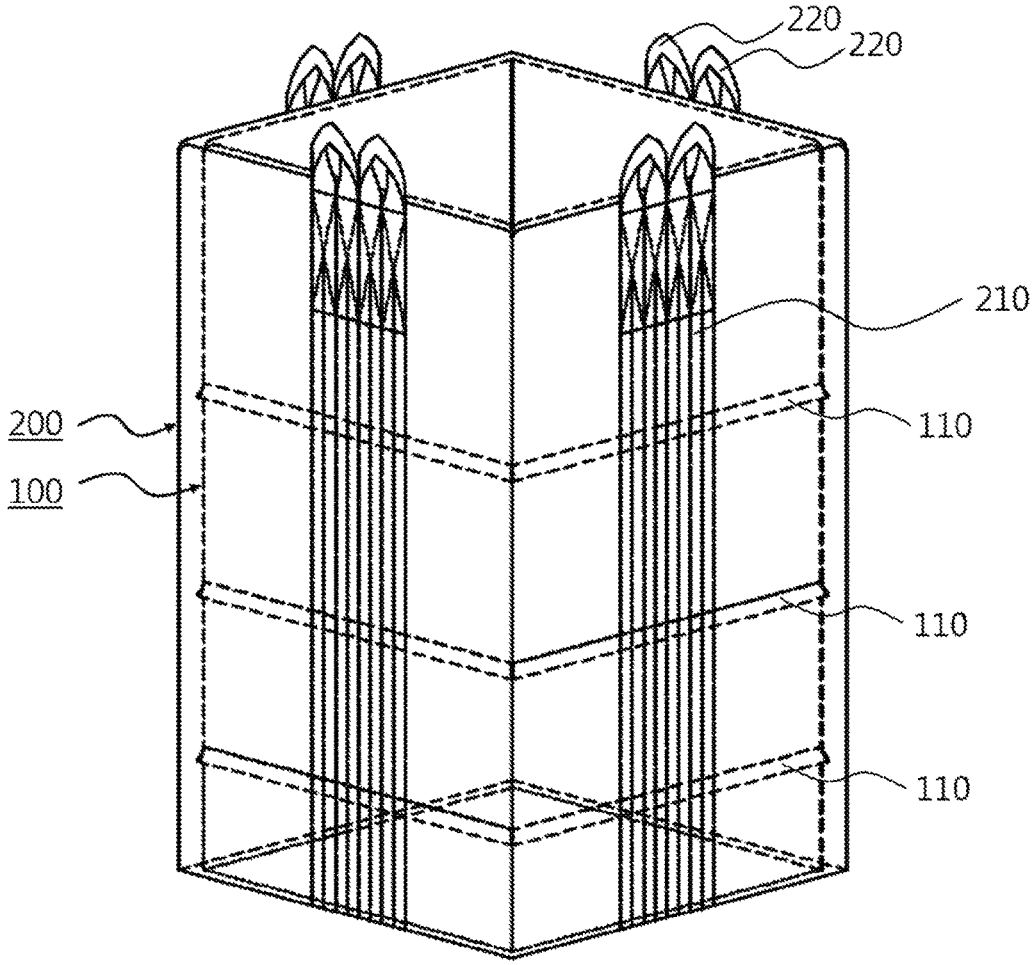
FIG. 8 shows an embodiment of a container bag after going through FIG. 6 and FIG. 7.
Figure 9:
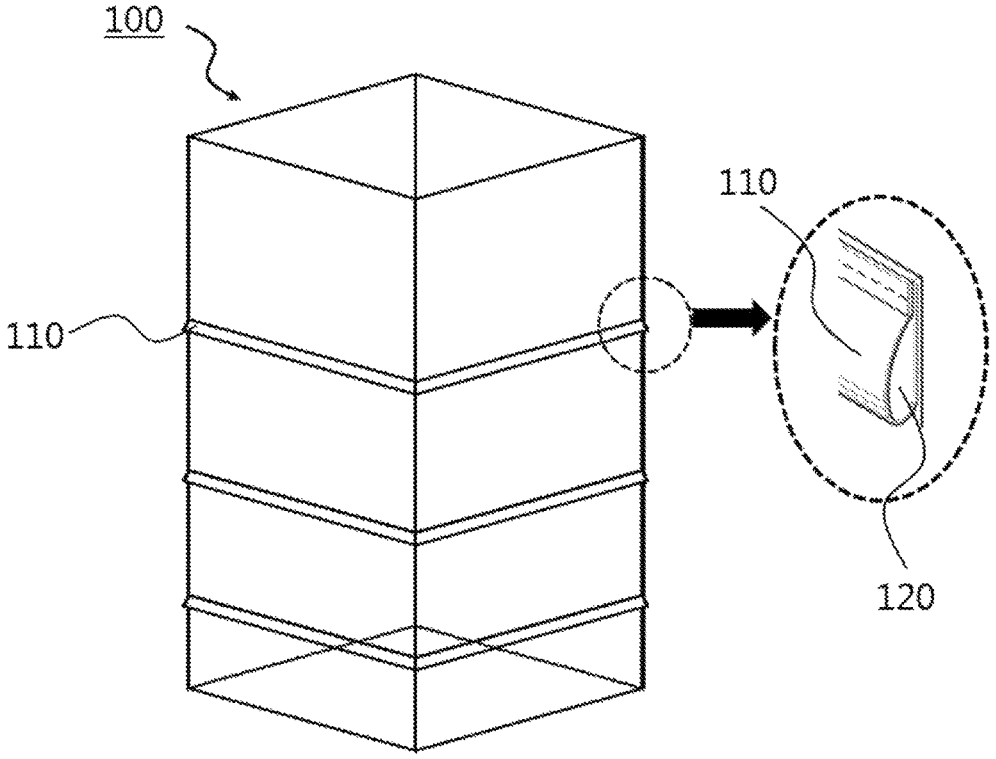
FIG. 9 shows an embodiment of the structure of the inner bag and lateral reinforcing portions according to the present invention.

As shown in FIG. 5, the fifth embodiment of the present manufacturing method comprises: (E1) weaving fabric used for a container bag 10 of a hollow structure; (E2) cutting container bag fabric in unit length; (E3) forming the lateral reinforcing portion 110 by folding a part of the inner bag on the inner bag 100 when either one of the upper or lower portion of the cut container bag is selected as the inner bag 100, and forming the vertical reinforcing portion 210 padded the reinforcing belt on the outer bag 200 when the other one is selected as the outer bag 200; (E4) placing the inner bag 100 into the outer bag 200 by turning the open end of the outer bag inside out.

The fifth embodiment is a case of forming the vertical reinforcing portion 210 and the lateral reinforcing portion 110 after weaving of the container bag fabric.

Hereinafter, the present invention will be described focusing on the above-described first embodiment.

In step A1, the vertical reinforcing portion 210 may be warp-reinforced woven portions which are woven such that warp more than weft is added thereto. For example, two or three stands of warp are woven relative to a single strand of weft. Accordingly, the present embodiment is an embodiment in which the vertical reinforcing portions 210 are formed at the step of weaving container bag fabric.

For example, In the case where the vertical reinforcing portion 210 is woven by three stands of warp relative to a single strand of weft, the tensile strength increases further. This is because two stands of warp are added compared with existing single stand of warp. Furthermore, when the vertical reinforcing portions 210 of the inner bag 100 and the outer bag 200 are overlapped by overlapping, the longitudinal strength is further increased.

In step A3, the lateral reinforcing portion 110 may be formed by folding the inner bag 100, and may have a internal path 120 in it. The lateral reinforcing portion according to the present invention functions like a girdle. The dictionary definition of 'girdle' means a belt or cord worn round the waist or a woman's elasticated corset.

The lateral reinforcing portions 110 according to the present invention are each formed by folding the inner bag outward in a lateral direction, and include one or more lateral reinforcing portions. The laterally folding portion may be completely or partially sewn.

When the laterally folding portion of each of the lateral reinforcing portions 110 is sewn, a non-sewn portion is provided with a path 120 inside which a space is formed. It is preferable that a reinforcing belt 130 is additionally inserted into the path 120 in order to enhance the prevention of the expansion phenomenon of the container bag.

In the case of the present invention, each of the inner bag and the outer bag may be provided in a single layer, the lateral reinforcing portion may be provided in two layers, and the reinforcing belt may be provided in a single layer. A portion without a lateral reinforcing portion, where the inner bag and the outer bag come into direct contact with each other, forms a total of two layers. A portion with a lateral reinforcing portion forms a total of four layers. A portion where a reinforcing belt is inserted into a lateral reinforcing portion forms a total of five layers.

The strengths of the respective reinforcing belts 130 may be the same, or may be different.

It is more preferable that when a plurality of lateral reinforcing portions 110 is provided to be spaced apart from each other, a reinforcing belt 130 inserted into a lower path 120 has a higher strength. The reason for this is that when contents are introduced into the container bag, a load is oriented downward due to gravity, and thus an expansion phenomenon is concentrated in the lower portion of the container bag.

There may be an embodiment in which the heights H of the respective lateral reinforcing portions 110 are the same or an embodiment in which the heights H of the respective lateral reinforcing portions 110 are different. Furthermore, there may be an embodiment in which the intervals I of the respective lateral reinforcing portions 110 are the same or an embodiment in which the intervals I of the respective lateral reinforcing portions 110 are different.

Figure 10:
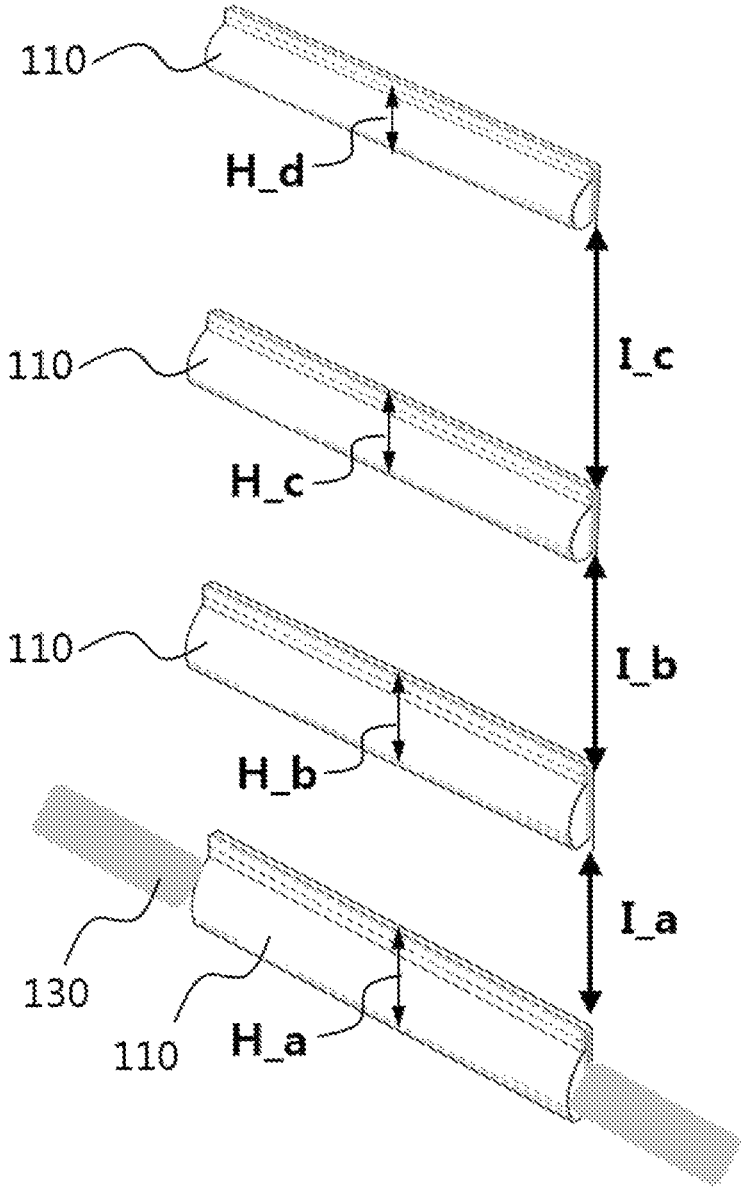
FIG. 10 shows an embodiment in which the heights H and intervals I of lateral reinforcing portions are different according to the present invention.

FIG. 10 shows an embodiment in which the heights H and intervals I of lateral reinforcing portions are different according to the present invention.

It is more preferable that when a plurality of lateral reinforcing portions 110 is provided, the height H of a lateral reinforcing portion 110 disposed in a lower portion is larger. FIG. 3 shows an embodiment in which the relationship "$H_a>H_b>H_c>H_d$" is satisfied.

It is more preferable that when lateral reinforcing portions 110 are three or more in number, the intervals I between the lateral reinforcing portions 110 decrease in a downward direction. FIG. 3 shows an embodiment in which the relationship "$I_a<I_b<I_c$" is satisfied.

When contents are introduced into the container bag, a load is oriented downward due to gravity, and thus an expansion phenomenon increases more in the lower portion of the container bag. Accordingly, it is preferable to increase the strength of the lower portion of the container bag.

As an embodiment in which the above-described embodiments are combined together, it is more preferable that the strength of a reinforcing belt 130 disposed in the lower portion of a container bag is higher, the height H of the lateral reinforcing portion 110 is larger, and a corresponding interval I is smaller.

Meanwhile, when the contents of a container bag are grain, there may be used a grain trier which pierces into the inside of the container bag from the outside of the container bag and extracts some of the grain introduced into the container bag. A grain trier is a grain extraction tool. For reference, FIG. 22 shows various types of grain triers.

If the container bag has a single layer or two layers (including an inner bag and an outer bag), a problem arises in that grain continues to be discharged through a portion which is pierced by a grain trier. Furthermore, the pierced portion may be increased and damaged.

Meanwhile, a total of three layers are obtained by adding the one layer of a reinforcing belt 130 to the two layers of the lateral reinforcing portion 110, and a total of five layers are obtained by adding the inner bag 100 and the outer bag 200 to the above three layers. Accordingly, even when a grain trier pieces a lateral reinforcing portion 110 at a location where a total of five layers are present and is taken out of the lateral reinforcing portion 110, grain is not additionally discharged. Furthermore, an advantage arises in that the pierced portion does not lead to significant damage.

After step A4, vertical reinforcing portions 210 are formed on each side of the outer bag 200, the lifting loops 220 are coupled to tops of the vertical reinforcing portions 210, and a connection portion 230 is passed through the lifting loops.

Figure 11:
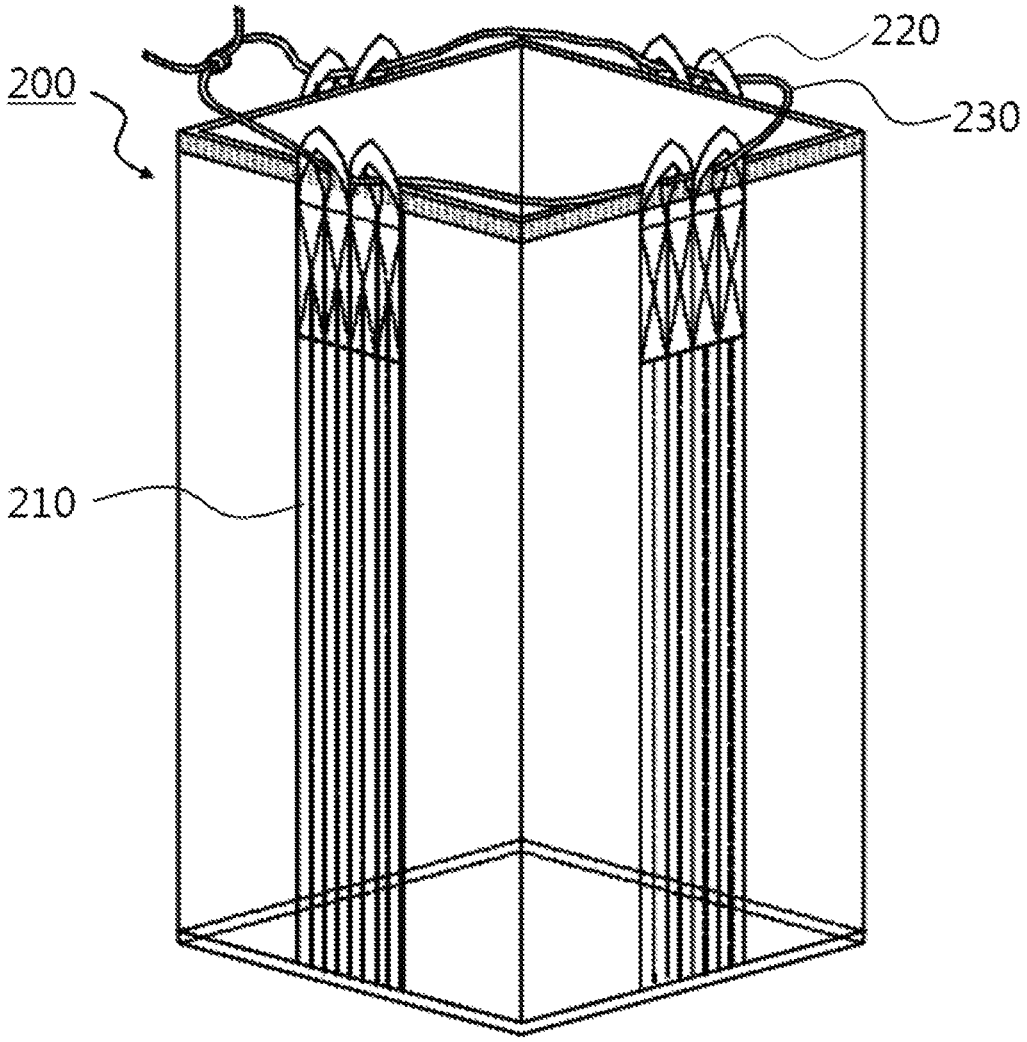
FIG. 11 shows an embodiment of the structure and technical configuration of the outer bag according to the present invention.
Figure 12:
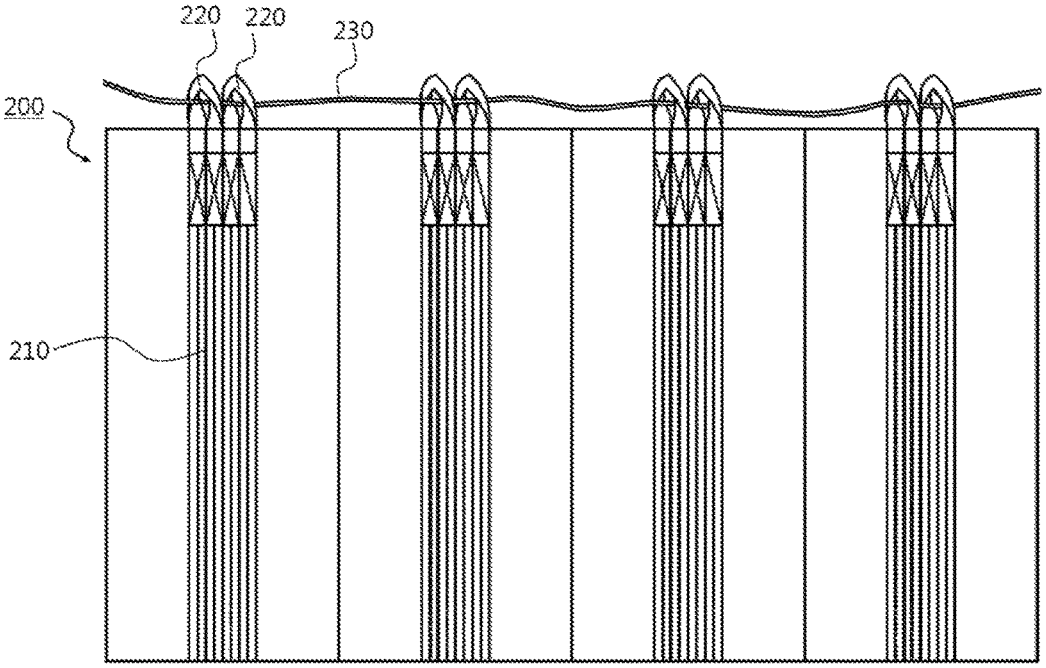
FIG. 12 shows a state in which the outer bag of FIG. 11 is spread laterally in order to describe the structure of the outer bag of FIG. 11.

FIG. 12 shows a state in which the outer bag of FIG. 11 is spread laterally in order to describe the structure of the outer bag of FIG. 11;

As shown in FIG. 12, it is preferable that the vertical reinforcing portions 210 are provided on center portions of each side surface of the outer bag.

Although the height of the tops of the lifting loops 220 according to the present invention is not limited, it is preferable that the tops of the lifting loops 220 are disposed at the same height as the top of the outer bag or above the top of the outer bag.

The connection portion 230 according to the present invention is applicable as long as it has one of various structures and shapes which enable passage through the lifting loops 220. Although the connection portion 230 is generally provided in a string shape, the connection portion 230 may have a belt shape or the like. In the present specification and the accompanying drawings, there is described an embodiment in which the connection portion 230 is provided in a string shape.

The connection portion 230(Z) is passed through a plurality of lifting loops. All types of connection portions capable of enabling passage are included in the present invention.

Meanwhile, in the present invention, in order to maintain an upright shape and a rectangular parallelepiped shape, variations attributable to a structure in which the connection portion 230 is passed through the lifting loops 220 have been examined.

Figure 16:
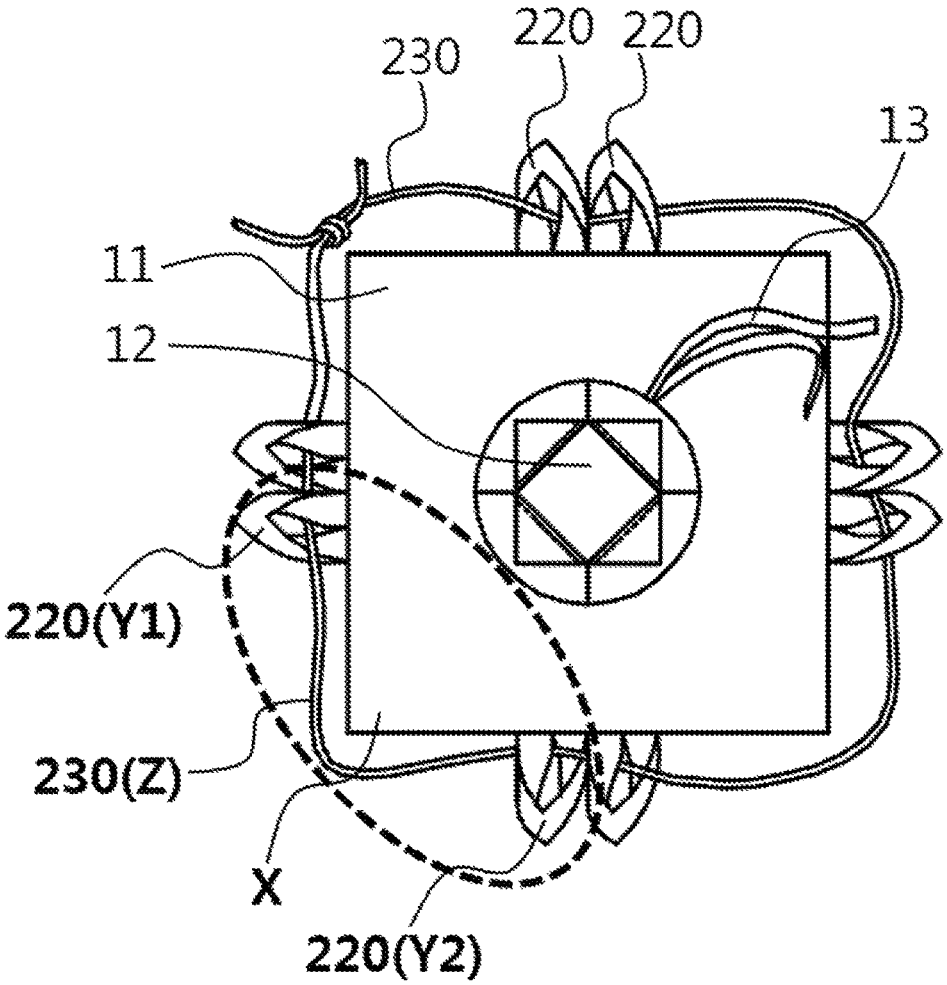
FIGS. 16*a* and 16*b* are a plan view and a bottom view showing an embodiment in which an upper plate and a lower plate are coupled to the container bag according to the present invention.
Figure 16:
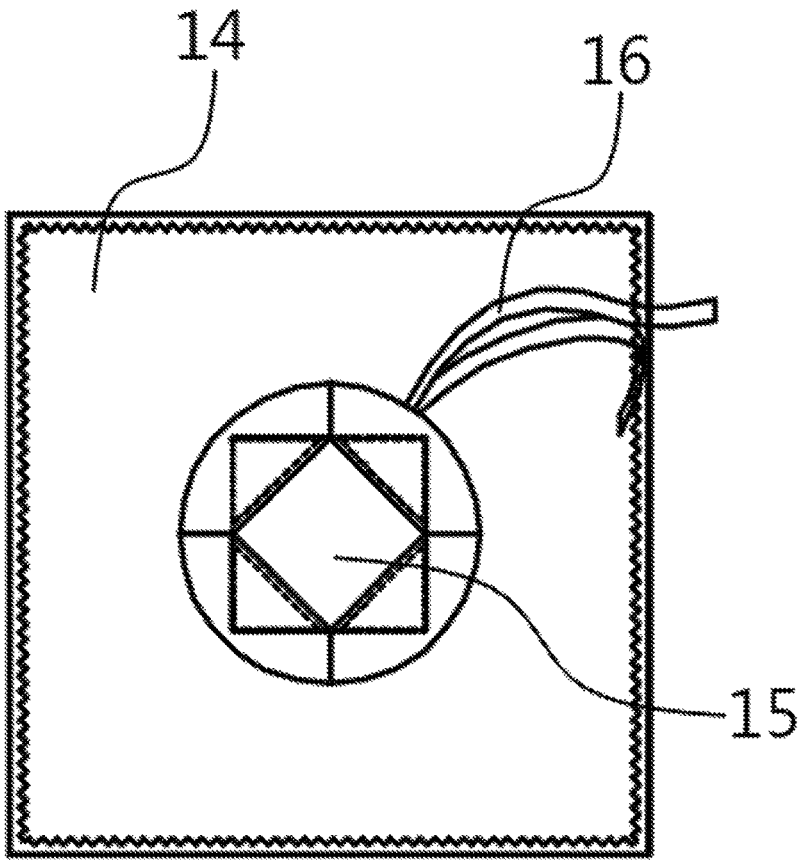
Figure 17:
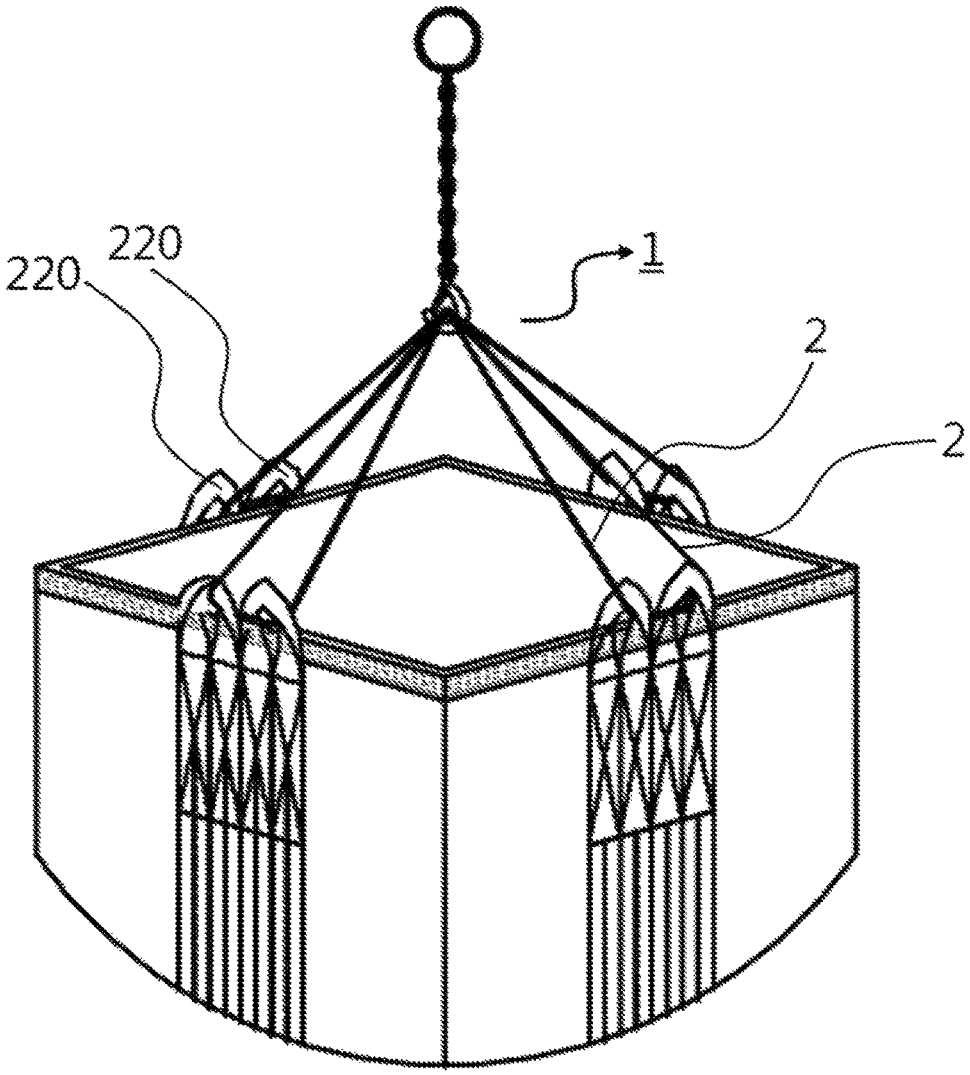
FIG. 17 shows a state in which a lifting string has been separately passed through lifting loops formed on the top of the outer bag.

As a result, as shown in FIG. 16*a*, it is preferable that a connection portion is passed through lifting loops 220(Y1) and 220(Y2) which are opposite to each other with the corner X of each side surface of the container bag disposed in between.

The connection portion 230 may be passed through at least two lifting loops 220. More preferably, the connection portion 230 is passed through all the lifting loops 220.

Figure 18:
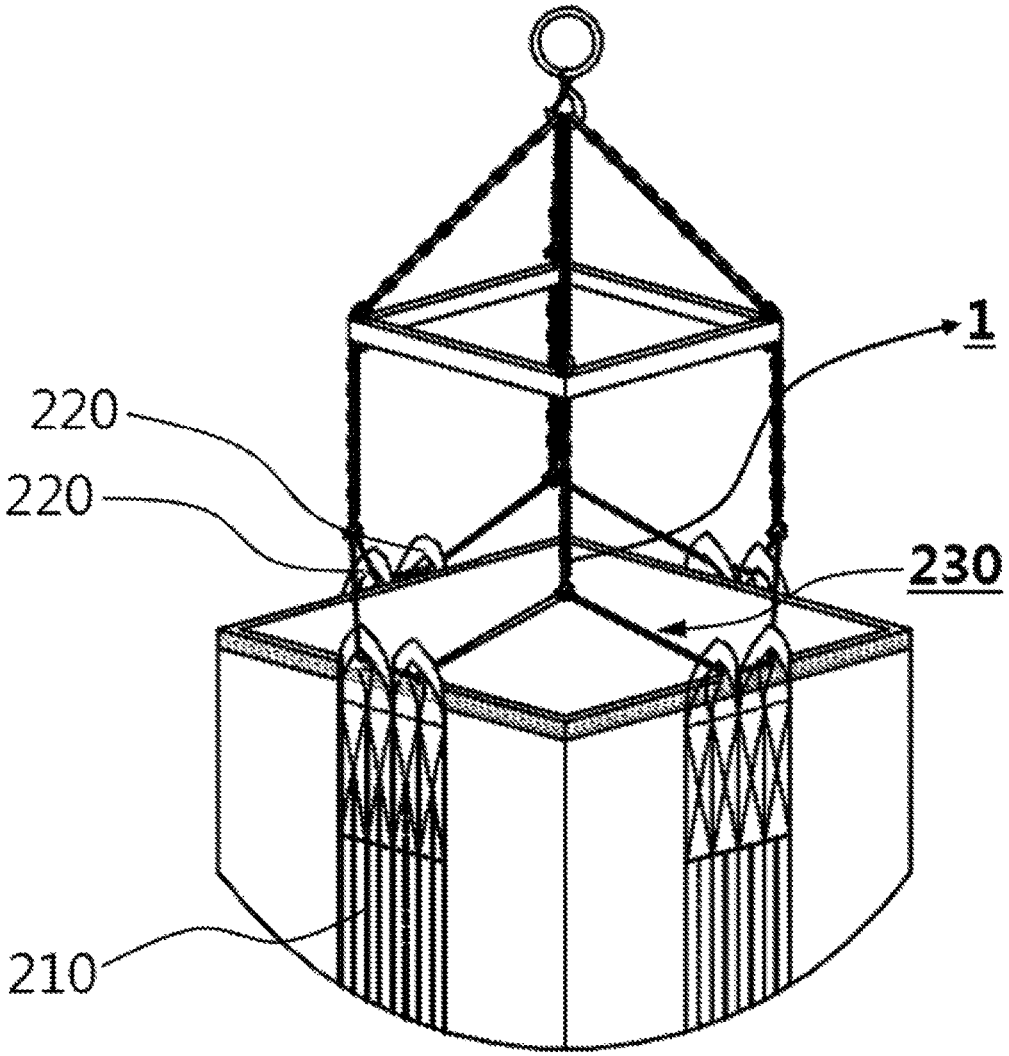
FIGS. 18*a* and 18*b* show an embodiment in which a lifting device is inserted down to the connection portion according to the present invention and lifts up the connection portion.
Figure 18:
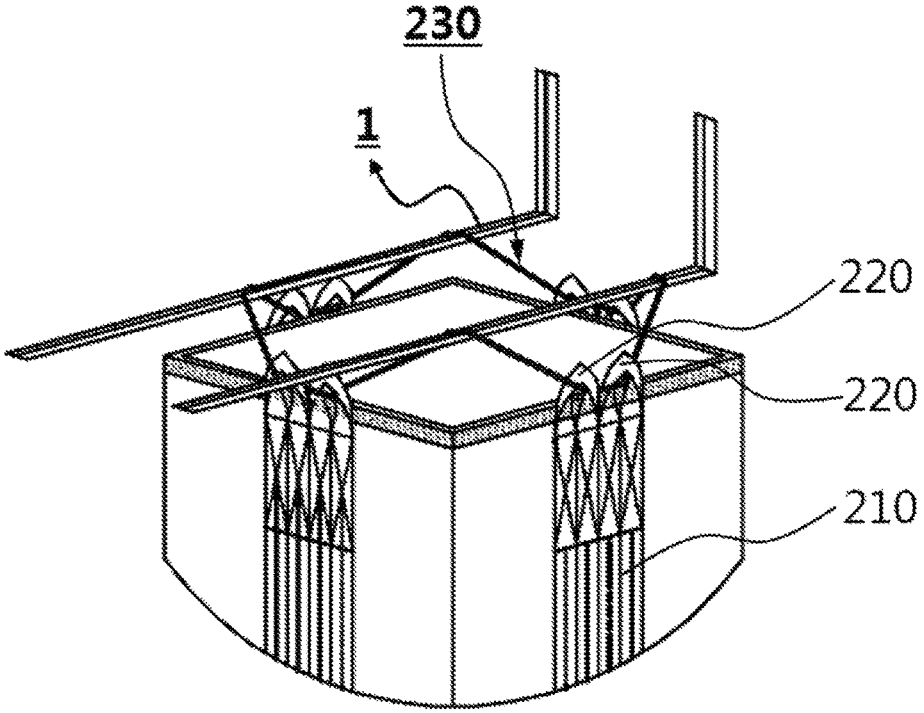
Figure 19:
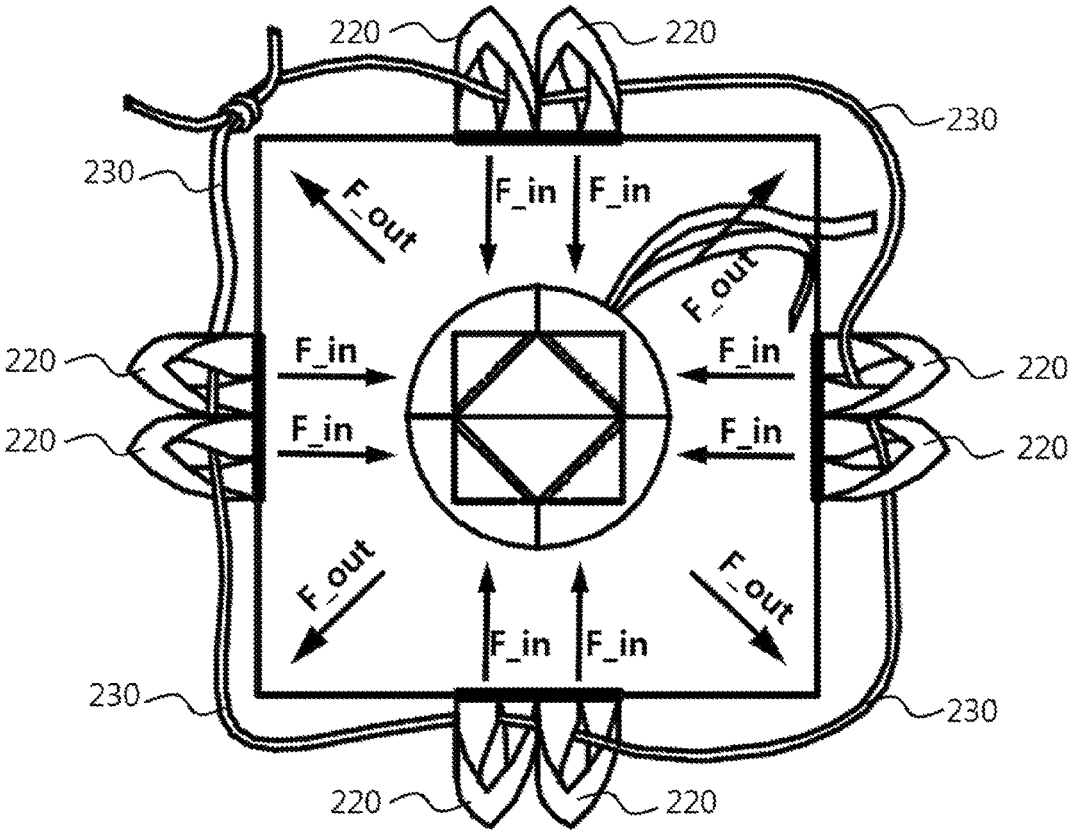
FIG. 19 shows the types and directions of forces which are applied to the inside of the container bag according to the present invention when the container bag is lifted.
Figure 20:
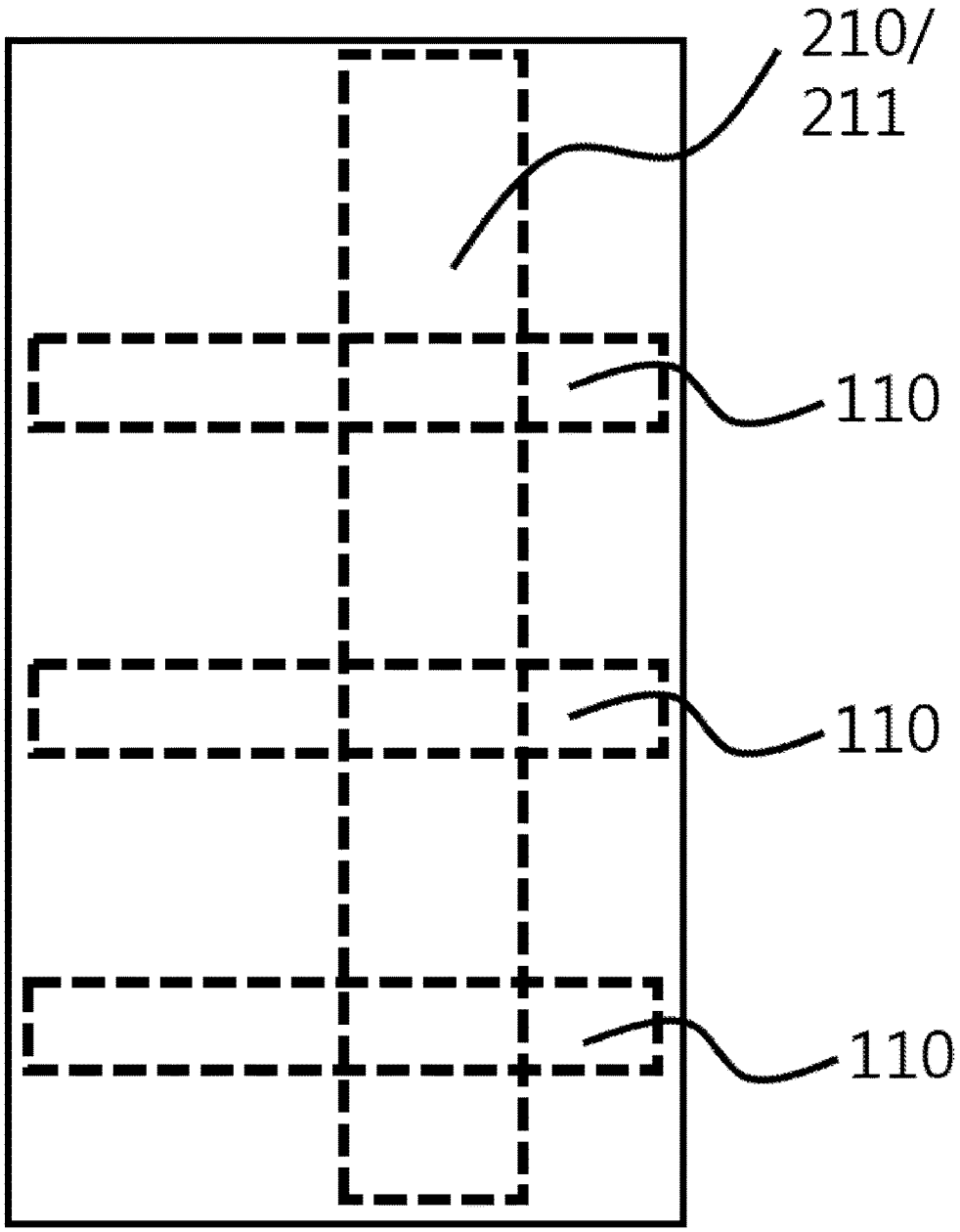
FIG. 20 shows an embodiment in which contents have been introduced into an actual product of the container bag according to the present invention and the actual product has been erected upright.

FIGS. 18*a*, 18*b* show an embodiment in which a connection portion is passed through the lifting loops which are opposite to each other with a corner disposed in between. In this embodiment, when a container bag is lifted, forces are applied to the container bag, as shown in FIG. 19.

In other words, when the lifting loops 220 are lifted, forces F_in oriented from the lifting loops to the inside of the container bag are applied. Meanwhile, forces F_out oriented out of the container bag are applied toward corners each present between a lifting loop on one side surface and a lifting loop on another side surface by the connection portion 230 which connects lifting loops 220 are opposite to each other with a corner disposed in between.

When the directions and strengths of forces inside the container bag are balanced by the above-described components, such as the vertical reinforcing portions 210, the lifting loops 220, the connection portion 230, etc., of the outer bag 200, the corners of the container bag are maintained, or the content introduced into the bag would be automatically distributed into the corner and thus the rectangular parallelepiped shape of the container bag can be maintained.

Meanwhile, a load is applied downward by introduced contents due to gravity. In this case, the expansion phenomenon of the lower portion of the container bag is prevented by the lateral reinforcing portions 110 of the inner bag 100. Accordingly, an overall upright and rectangular parallelepiped shape is maintained.

Figure 13:
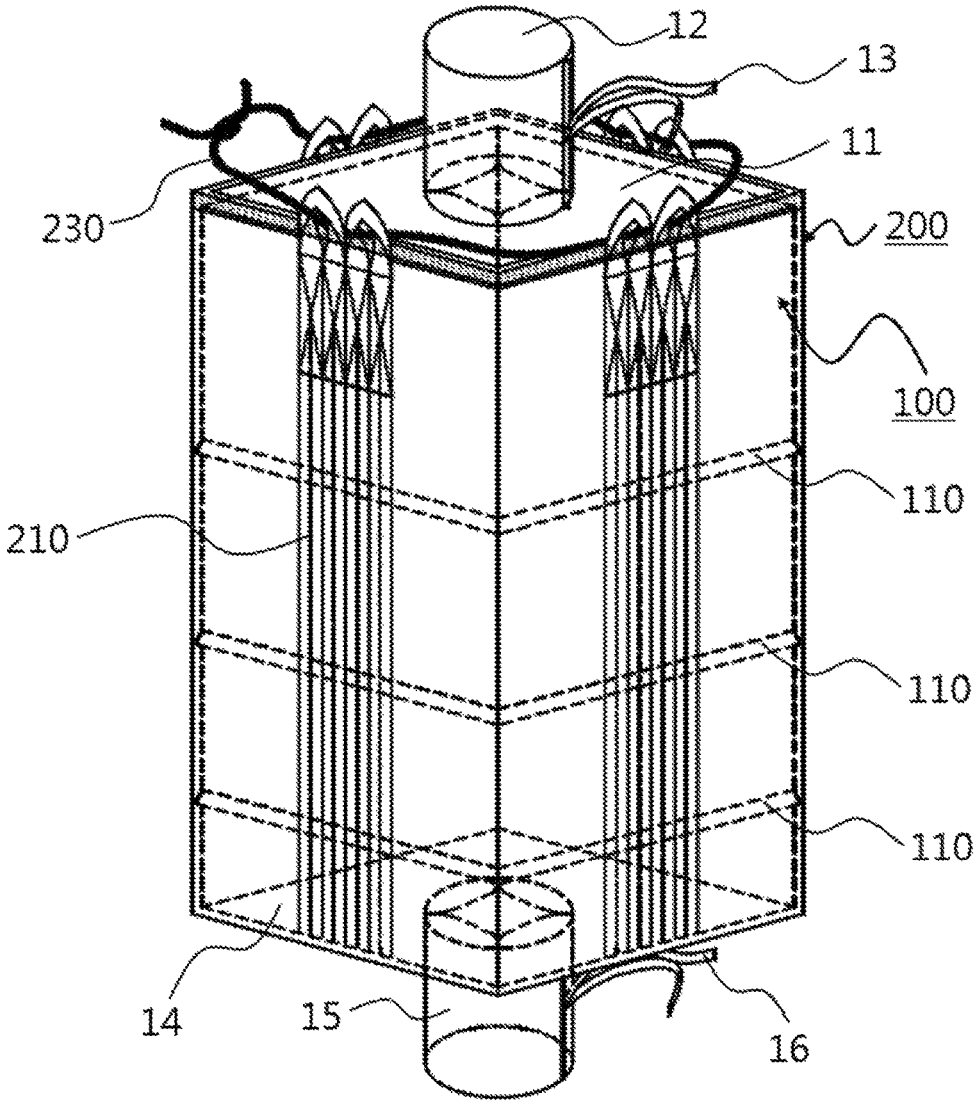
FIG. 13 shows the structure of the inner bag using dotted lines in a state in which the inner bag and the outer bag are disposed by overlapping.
Figure 14:
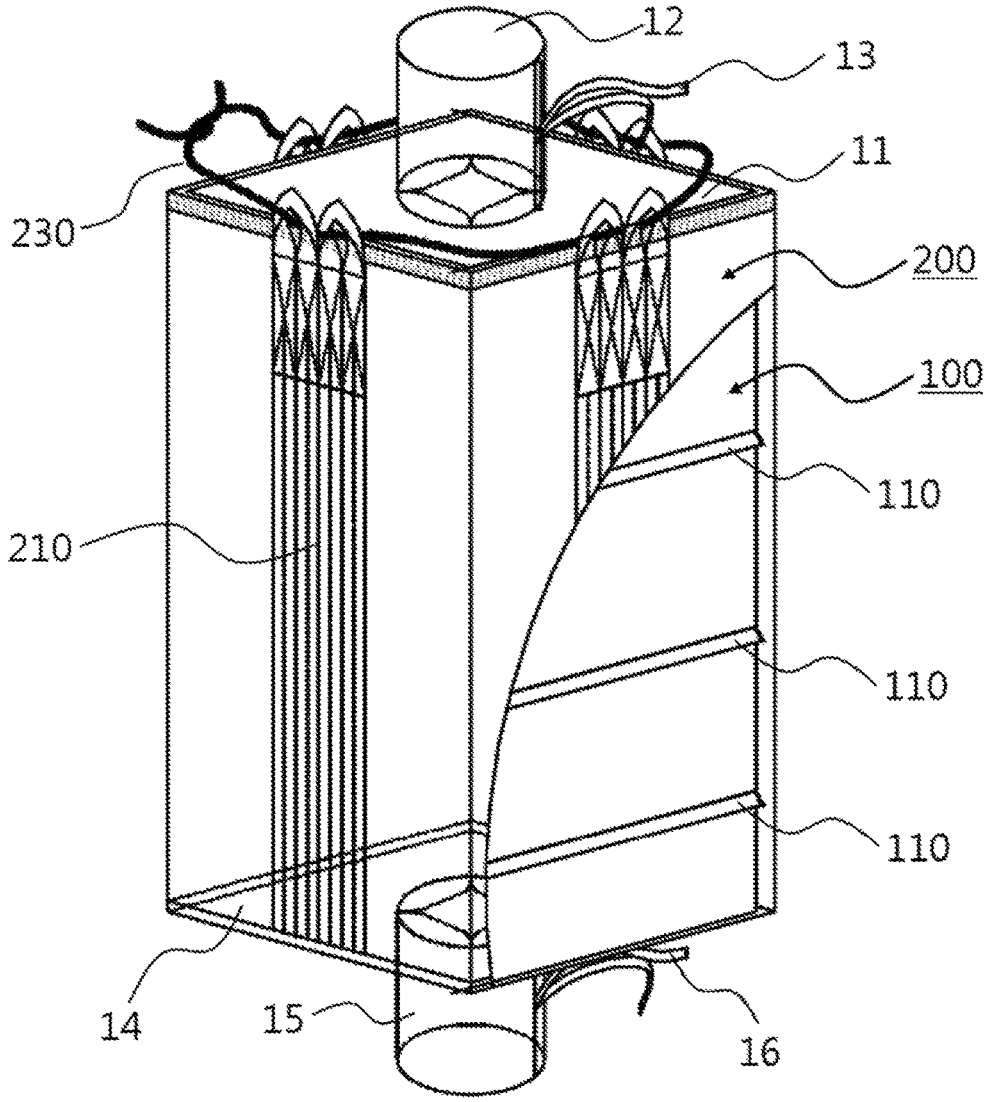
FIG. 14 shows the structures of the outer bag and the inner bag by cutting a part of the outer bag in a state in which the inner bag is disposed in the outer bag by overlapping.
Figure 15:
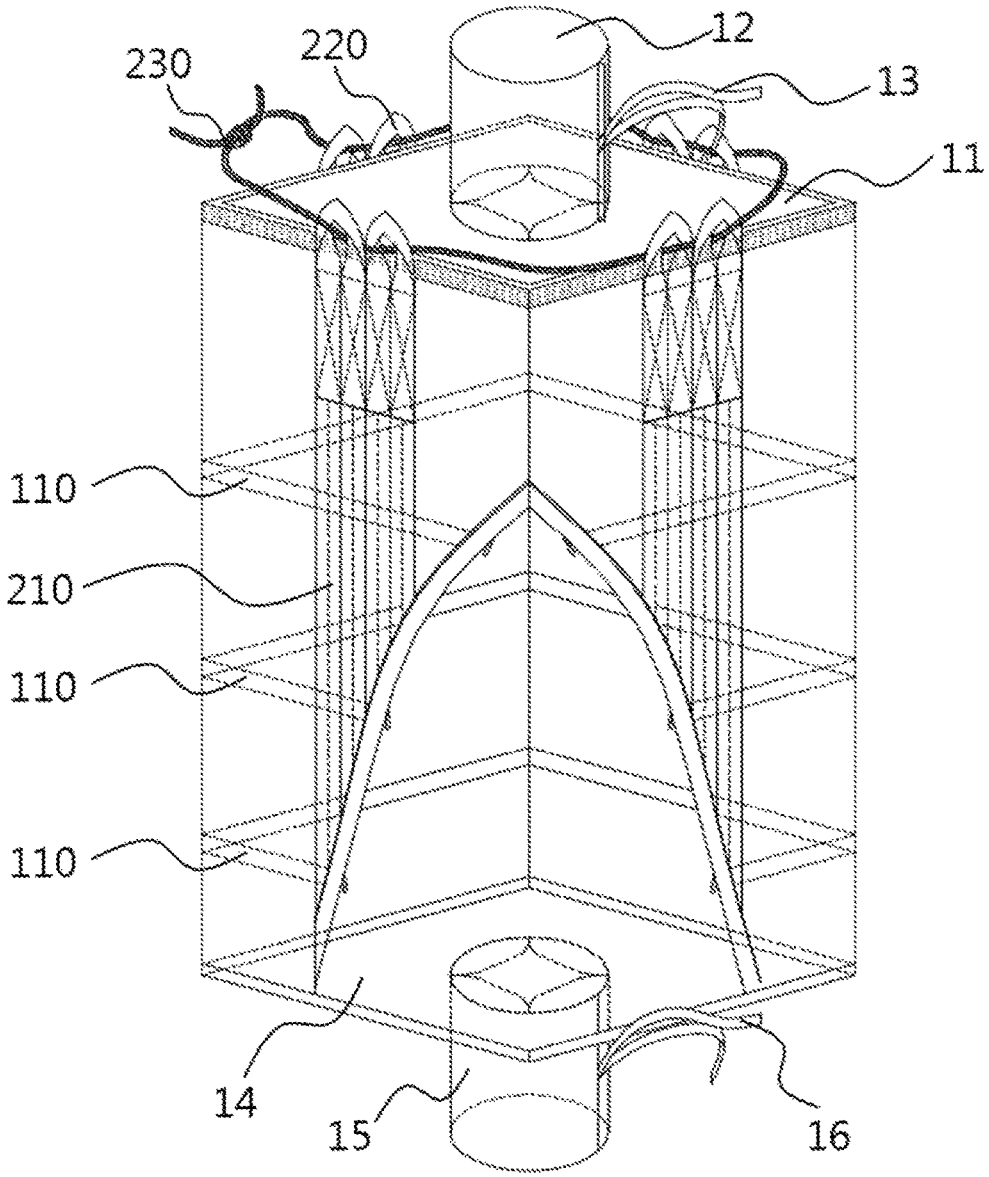
FIG. 15 shows the internal structure of the inner bag in in a state in which the inner bag is disposed in the outer bag by overlapping.

After step A4, it is preferable that an upper plate 11 and a lower plate 14 are coupled to the open top and bottom of the container bag, respectively. As shown in FIG. 13, an introduction entrance 12 and a tightening strap 13 may be provided on the upper plate 11, and an exit 15 and a tightening strap 16 may be provided on the lower plate 14.

Meanwhile, depending on the type of contents introduced into the container bag, a lamination layer (not shown) configured to perform a function, such as a waterproof function, an anti-fouling function, an insulation function, or the like, may be required. In this case, since the lamination layer and the charged materials do not contact each other, there is also the effect of preventing contamination due to contact with the lamination layer. It is preferable that the lamination layer is formed on at least one of the outside of the inner bag 100 and the inside of the outer bag 200.

In the present invention, it is preferable that the lamination layer is formed on surface of container bag fabric when step A1 is ended and step A2 is before the start or when step A2 is ended and step A3 is before the start.

Furthermore, when contents introduced into the container bag are hygroscopic or powder materials, a liner (not shown) may be additionally disposed in the internal space of the inner bag 100.

While it is difficult to additionally dispose a liner inside a conventional inner bag in which partitions are formed, an advantage arises in that the liner can be freely disposed inside the container bag according to the present invention because the inner bag of the container bag does not include the partitions.

The present invention includes the container bags manufactured by the above-described manufacturing methods. Specifically, it includes all the container bags manufactured in accordance with the first embodiment to the fifth embodiment.

In order to aid understanding of the present invention, an embodiment of a container bag according to the present invention will be further described.

The present invention relates to an overlap-structured container bag having an inner bag and an outer bag made by turning container bag fabric inside out. Either one of the upper or lower portion of the cut container bag is selected as the inner bag 100, the other one is selected as the outer bag 200. The inner bag 100 is placed into the outer bag 200 by turning container bag fabric inside out.

The lateral reinforcing portions are formed by folding a part of the inner bag and are provided on the inner bag.

The vertical reinforcing portions may be provided on the respective side surfaces of the outer bag 200.

The internal path 120 may be provided inside the lateral reinforcing portion 110. The reinforcing belt 130 may be inserted into the internal path 120.

The vertical reinforcing portions 210 may be warp-reinforced woven portions which are woven such that warp more than weft is added thereto or may be formed by adding reinforcing belts.

When the vertical reinforcing portion 210 is the warp-reinforced woven portion, it is preferable that the warp-reinforced woven portion 211 also may be formed on the inner bag 100.

The outer bag 200 includes the lifting loops 220 which are coupled to tops of the vertical reinforcing portions 210, and and a connection portion 230 which is passed through the lifting loops 220.

The vertical reinforcing portions 210 may be provided on center portions of each side surface of the outer bag 200.

The two lifting loops 220 may be disposed on the top of each vertical reinforcing portion 210 in parallel.

The connection portion 230 may be passed through lifting loops which are opposite to each other with the corner of each side surface of container bag in between.

The overlap-structured container bag having an inner bag inserted into an outer bag according to the present invention has the following advantages:

First, an advantage arises in that manufacturing process is symplified through the configuration where the inner bag and the outer bag are disposed by turning the same container bag fabric inside out.

Second, an advantage arises in that the lateral reinforcing portions are formed on the inner bag, and can thus prevent an expansion phenomenon by forming multiple layers in that position.

Third, an advantage arises in that the vertical reinforcing portions are formed on the outer bag, and can thus prevent an expansion phenomenon and maintain the upright and rectangular parallelepiped shape of the container bag.

Fourth, an advantage arises in that when the container bag is lifted, forces are applied to adjacent lifting loops by the separate connection portion connecting the lifting loops, and can thus maintain an upright and rectangular parallelepiped shape while maintaining corners.

The advantage of the present invention are not limited to those mentioned above, and other advantages which are not mentioned can be clearly understood by those skilled in the art from the above detailed description.

The embodiments described herein and the accompanying drawings are intended merely to illustrate part of the technical spirit included in the present invention. Accordingly, the embodiments disclosed herein are not intended to limit the technical spirit of the present invention, but are intended to illustrate the technical spirit. Therefore, it will be apparent that the scope of the technical spirit of the present invention is not limited by the embodiments. All modifications and specific embodiments which can be easily derived by those skilled in the art within the range of the technical spirit included in the present specification and the accompanying drawings should be construed as falling within the range of the rights of the present invention.

What is claimed is:

1. A manufacturing method for overlap-structured container bag comprises:

(A1) weaving fabric to form a container bag fabric used for a container bag of a hollow structure while a plurality of vertical reinforcing portions are formed;

(A2) cutting the container bag fabric in unit length;

(A3) selecting an upper or lower portion of the cut container bag fabric as an inner bag and forming at least one lateral reinforcing portion on the inner bag;

(A4) selecting an outer bag on the other of the upper or lower portion of the cut container bag fabric where the at least one lateral reinforcing portion is not formed and placing the inner bag into the outer bag by turning an open end of the outer bag inside out; and wherein the at least one lateral reinforcing portion is formed to have a folded portion by folding a part of the inner bag outward in a lateral direction, and is disposed in a space between the inner bag and the outer bag.

2. The manufacturing method for overlap-structured container bag of claim 1, wherein the plurality of vertical reinforcing portions of the step A1 are warp-reinforced woven portions which are woven such that warp more than weft is added thereto.

3. The manufacturing method for overlap-structured container bag of claim 1, wherein each of the at least one lateral reinforcing portions of the step A3 has a structure in which the folded portion is completely sewn without an internal path, or a structure in which the folded portion is partially sewn with an internal path.

4. The manufacturing method for overlap-structured container bag of claim 3, wherein a reinforcing belt is inserted into the internal path.

5. The manufacturing method for overlap-structured container bag of claim 4, wherein the at least one lateral reinforcing portions comprises a plurality of lateral reinforcing portions, and the strengths of respective reinforcing belts are stronger at a lower position.

6. The manufacturing method for overlap-structured container bag of claim 1, wherein the at least one lateral reinforcing portions comprises a plurality of lateral reinforcing portions, and the heights H of respective lateral reinforcing portions are higher at a lower position.

7. The manufacturing method for overlap-structured container bag of claim 1, wherein the at least one lateral reinforcing portions is three or more in number, and intervals between the lateral reinforcing portions are narrower at a lower position.

8. The manufacturing method for overlap-structured container bag of claim 1, wherein:

after the step A4, the plurality of vertical reinforcing portions include vertical reinforcing portions formed on each side surface of the outer bag;

lifting loops are coupled to tops of the vertical reinforcing portions; and a connection portion is passed through the lifting loops.

9. The manufacturing method for overlap-structured container bag of claim 8, wherein:

the vertical reinforcing portions are provided on center portions of each of the side surface of the outer bag; and each of the lifting loops coupled to the tops of each of the vertical reinforcing portions comprises two lifting loops disposed in parallel.

10. The manufacturing method for overlap-structured container bag of claim 8, wherein tops of the lifting loops are disposed at the same height of tops of the outer bag or are disposed above the tops of the outer bag.

11. The manufacturing method for overlap-structured container bag of claim 8, wherein the connection portion is passed through the lifting loops which are opposite to each other with a corner of each side surface of the container bag disposed in between.

12. The manufacturing method for overlap-structured container bag of claim 11, wherein the connection portion is passed through at least two lifting loops of the lifting loops.

13. The manufacturing method for overlap-structured container bag of claim 8, wherein the connection portion is provided in a belt or a string shape.

14. The manufacturing method for overlap-structured container bag of claim 1, where, after the step A4, an upper plate and a lower plate are coupled to an open top and bottom of the container bag, respectively.

15. The manufacturing method for overlap-structured container bag of claim 1, wherein a lamination layer is formed on a surface of the container bag fabric after the step A1 and before the step A2 or after the step A2 and before the step A3.

16. The manufacturing method for overlap-structured container bag of claim 1, wherein a liner is additionally disposed in an internal space of the inner bag.

17. An overlap-structured container bag made by the manufacturing method according to claim 1.

18. A manufacturing method for overlap-structured container bag comprises:

(D1) weaving fabric to form a container bag fabric used for a container bag of a hollow structure;

(D2) cutting the container bag fabric in unit length;

(D3) selecting an upper or lower portion of the cut container bag fabric as an inner bag and forming a lateral reinforcing portion on the inner bag by folding a part of the inner bag;

(D4) selecting an outer bag on the other of the upper or lower portion of the cut container bag fabric where the lateral reinforcing portion is not formed and placing the inner bag into the outer bag by turning an open end of the outer bag inside out; and wherein the lateral reinforcing portion is formed by folding the part of the inner bag outward in a lateral direction, and is disposed in a space between the inner bag and the outer bag.

19. A manufacturing method for overlap-structured container bag comprises:

(E1) weaving fabric to form a container bag fabric used for a container bag of a hollow structure;

(E2) cutting the container bag fabric in unit length;

(E3) selecting an upper or lower portion of the cut container bag fabric as an inner bag and forming a lateral reinforcing portion on the inner bag by folding a part of the inner bag, and selecting an outer bag on the other of the upper or lower portion of the cut container bag fabric where the lateral reinforcing portion is not formed and forming a vertical reinforcing portion comprising a padded reinforcing belt on the outer bag;

(E4) placing the inner bag into the outer bag by turning an open end of the outer bag inside out; and wherein the lateral reinforcing portion is formed by folding the part of the inner bag outward in a lateral direction, and is disposed in a space between the inner bag and the outer bag.

20. An overlap-structured container bag having an inner bag and an outer bag made by turning a container bag fabric inside out, wherein:

one of an upper or lower portion of the cut container bag fabric is selected as the inner bag; and the other one of the upper or lower portion is selected as the outer bag;

the inner bag is placed into the outer bag by turning the container bag fabric inside out;

lateral reinforcing portions are formed by folding a part of the inner bag, and are provided on the inner bag;

vertical reinforcing portions are provided on respective side surfaces of the outer bag; and the lateral reinforcing portions are formed by folding the part of the inner bag outward in a lateral direction, and are disposed in a space between the inner bag and the outer bag.

21. The overlap-structured container bag of claim 20, wherein:

an internal path is provided inside of each of the lateral reinforcing portions; and a reinforcing belt is inserted into the internal path.

22. The overlap-structured container bag of claim 20, wherein the vertical reinforcing portions are warp-reinforced woven portions which are woven such that warp more than weft is added thereto.

23. The overlap-structured container bag of claim 22, wherein the warp-reinforced woven portions are formed on the inner bag.

24. The overlap-structured container bag of claim 22, wherein:

the outer bag includes lifting loops which are coupled to tops of the vertical reinforcing portions, and a connection portion;

the vertical reinforcing portions are provided on center portions of each side surface of the outer bag;

the lifting loops comprise two lifting loops disposed on the tops of each of the vertical reinforcing portion in parallel;

the connection portion is passed through lifting loops of the lifting loops which are opposite to each other with a corner of each side surface of the container bag in between.

* * * * *